United States Patent [19]

Yang

[11] Patent Number: 4,617,842

[45] Date of Patent: Oct. 21, 1986

[54] COMBINATION CAN OPENER

[76] Inventor: James C. H. Yang, 23328 Dorset P1., Harbor City, Calif. 90710

[21] Appl. No.: 668,309

[22] Filed: Nov. 5, 1984

[51] Int. Cl.[4] ..... B67B 7/44

[52] U.S. Cl. ..... 81/3.09; 81/3.55

[58] Field of Search ..... 81/3.07, 3.09, 3.4, 81/3.55, 3.29, 3.57

[56] References Cited

U.S. PATENT DOCUMENTS

| | | | |
|---|---|---|---|
| D. 269,587 | 7/1983 | Hanslmair | D8/40 |
| D. 274,688 | 7/1984 | Escalante | D8/40 |
| 4,507,988 | 4/1985 | Lo Faso et al. | 81/3.29 |
| 4,524,646 | 6/1985 | Kimberlin, Jr. | 81/3.55 |

*Primary Examiner*—Roscoe V. Parker

*Attorney, Agent, or Firm*—Sheldon & Mak

[57] ABSTRACT

A combination cap and can opener with a single working end is suitable for opening a capped bottle and for opening a press-off easy-open can. The opener can be only about 5 cm long, and is adapted for portability.

5 Claims, 6 Drawing Figures

COMBINATION CAN OPENER

BACKGROUND OF THE INVENTION

People are often hurt by the sharp edge of conventional pull-off easy-open cans when they pull off the seal because of carelessly holding or tramping onto said seal. In order to solve this problem, it would be better to let the metal can seal remain attached to the can while not allowing it to affect pouring the beverage out of the can. Therefore, a press-off easy-open can is on sale on the market as shown in FIGS. 1 and 2. In the can cap 11, a tongue-shaped can seal 12 has a perimeter with seam 13 except at the joint 121. A retained cap or tab 21 is riveted onto a riveting point 111 on the can cap 11 near the outer side of seam 13 of the tongue-shaped can seal 12, and the end 23 of restained cap 21 is tightly contacted with the upper edge of the tongue-shaped can seal 12. As a rule, we use a thumb and an index finger: to simultaneously pull up the lip rest 22 of the retained cap 21, and press down the end 23 of the retained cap 21 so as to force the tongue-shaped can seal 12 to split off from the seam 13 toward the inside of the can. However, when pulling up the lip rest 22 of retained cap 21 and pressing down the end 23 thereof, the nail and finger of a woman or child are easily hurt because their nails are weaker or longer and their skin is more tender.

Therefore, a can and crown cap opener has been provided as shown in FIG. 3. It is made of plastic and is about 15 cm long and looks like a combination wrench, one end of which is a box end 32, and the other end of which is an open end 33 with a jaw 331. A point 331*a* at the bottom edge of the jaw 331 is designed to cement the jaw 331, and a blade 332 below the rear of the jaw 331 is opposite to the jaw 331. Making use of the designed acute angle of the lip rest of the blade 332 and the incline at the upper edge of the blade 332, and the strong thrust transmitted by a large handle 31 to be held suitably in the user's palm, it is enough to easily pull up the retained cap 21 on the can cap 11 so that the end 23 of the retained cap 21 generates sufficient pressure to rapidly split off the tongue-shaped can seal 12 by pressing down the can cap 11. This can and cap crown opener may be also used to open caps by making use of the box end 32 of said opener. However, due to the large size, this opener is inconvenient for portability, so it is confined to be used at home. This simple and practical design of the box end 32 and open end 33 of said opener is related to the large handle 31 thereof which is convenient to be held in the user's palm so as to generate a strong thrust, pull and torque in the interest of opening a bottle or can by means of the box end 32 and open end 33 respectively. If the handle 31 of such a can and crown cap opener is not particularly large, it is difficult to apply force to open a can or bottle. If the handle 31 is too short, the thrust to be generated will be inadequate, the blade 332 will be inserted below the bottom edge of the retained cap 21, and when the lip rest 22 of retained cap 21 is pulled up, the insufficient thrust will cause the opener to slide off the lip rest 22 of the retained cap 21. However, the press-off easy-open canned beverage is often bought from the automatic vending machine at the beverage and food shop or in the car for outdoor activity. In these circumstances, it is almost impossible to bring such a large can and crown cap opener along.

In view of the above, the present invention is related to a portable and pocket-size combination can opener which is made of a light and hard metal by making use of a simple formative design.

The primary object of this invention is to offer a portable, press-off, easy-open combination can opener.

The secondary object of this invention is to offer a combination can opener with an open end capable of dual functions of opening press-off easy-open cans and bottle caps in general.

Another object of this invention is to offer a combination can opener with a hang ring at one end capable of being hooked and hung on a key chain in favor of portability.

The present invention is characterized in that the lip rest of a lance formed below the rear of the jaw at the open end of the gripper is at an acute angle, the thickness of the edge of said end is one-half smaller than the lip rest of the retained cap of the press-off easy-open can in general, and the fillister on the inner edge of said lance is suitable for catching the lip rest of the retained cap to form a coupling relationship.

NUMBERS IN THE DRAWINGS

Figure 1:
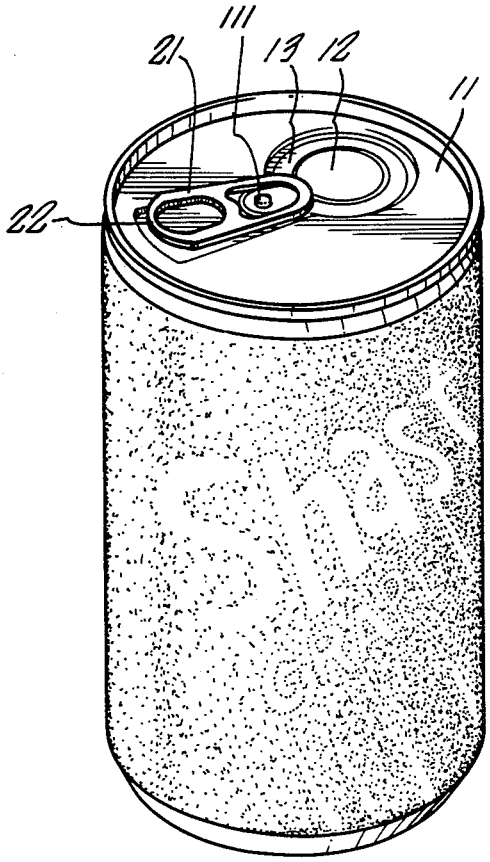
FIG. 1 is an elevation view of a press-off easy-open can.
Figure 2:
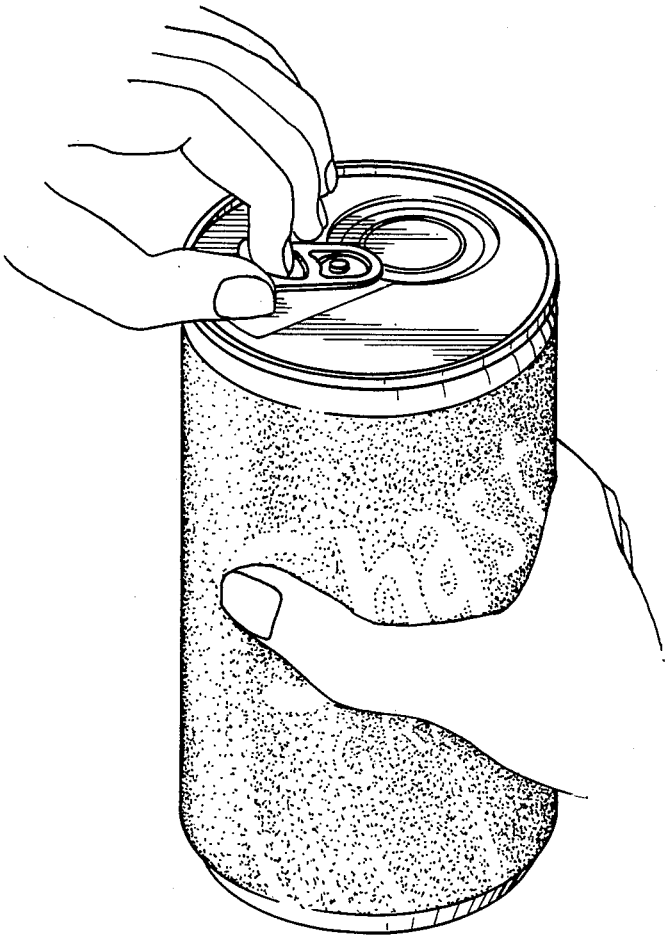
FIG. 2 is an elevation view of a press-off easy-open can half opened by fingers.

11: can cap
111: riveting point
12: tongue-shaped can seal
121: joint of tongue-shaped can seal and can cap
13: seam between tongue-shaped can seal and can cap
21: retained cap, or tab
22: lip rest, or lip, of retained cap
23: front end of tab
31: handle (31-322 relate to prior art opener)
32: box end
33: open end
331: jaw
331*a*: point of jaw
332: blade (31-332 relate to prior art opener)
41: gripper
42: open end of combination can and cap opener
421: jaw of combination can and cap opener
421*a*: base portion of jaw
421*b*: front tip portion of jaw
421*c*: projection on base portion of jaw
422: lance
422*a*: lip rest of lance
422*b*: fillister
422*c*: end edge of lance
423: upper edge of lance
424: bottom edge of lance
43: tail end of gripper
431: hang ring
44: front section of gripper
51: bottle 52: bottle cap

DETAILED DESCRIPTION OF THE INVENTION

Figure 4:
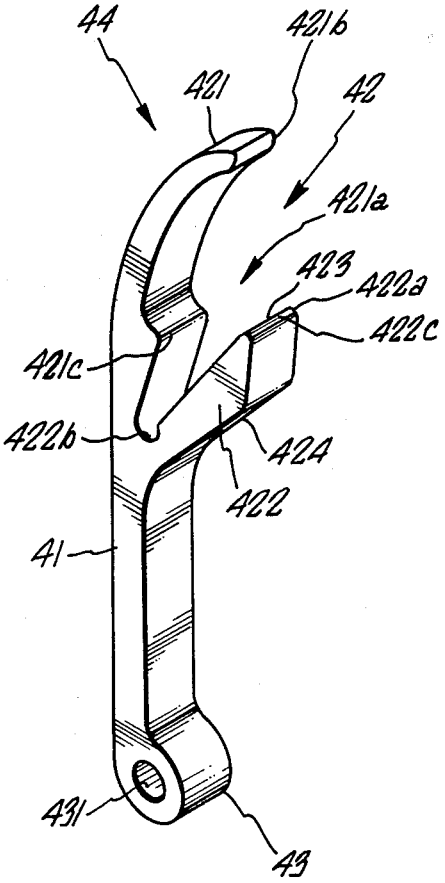
FIG. 4 is an elevation view of one embodiment of the present invention.
Figure 3:
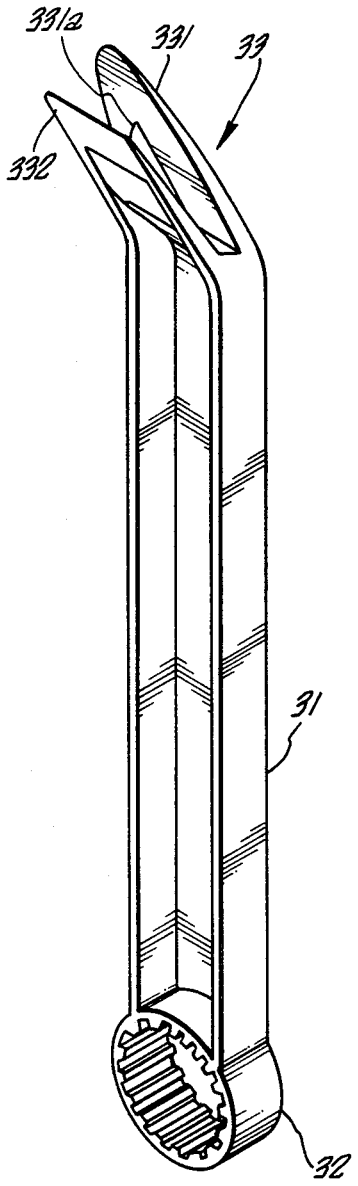
PRIOR ART FIG. 3.
FIG. 3 is an elevation view of a can and crown cap opener in general.
Figure 5:
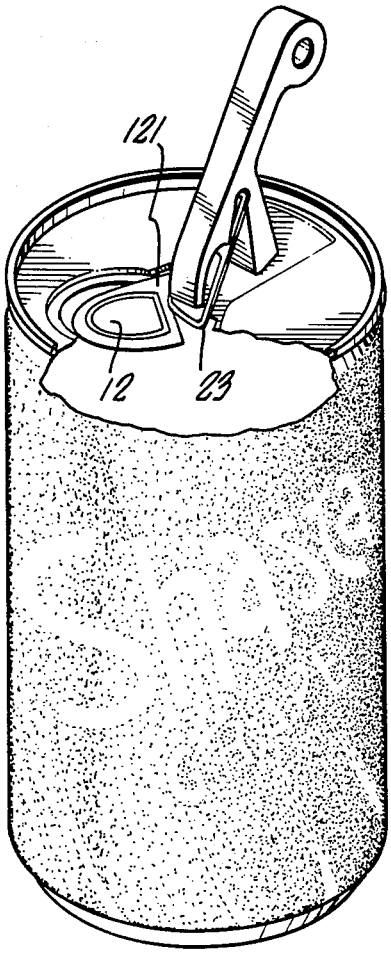
FIG. 5 is an elevation view of a press-off easy-open can according to one embodiment of this invention.

This invention may be best described in keeping with the preferred embodiment in conjunction with the accompanying drawings:

As shown in FIGS. 4 and 5, the open end 42 of the front section 44 of the gripper 41 of this combination can opener consists of a downward arched jaw 421 and a lance 422 below the rear of jaw 421. The upper edge 423 of said lance 422 is at a suitable incline extended from the lip rest 422*a* to the gripper 41. The jaw 421 therefore extends above and forwardly of the lance 422. The jaw 421, as shown in FIG. 4, has a base portion 421*a* and a front tip portion 421*b*, with the front tip portion 421*b* arching forwardly and downwardly toward the lance 422. The base portion 421*a* of the jaw has a projection 421*c*. A fillister 422*b* is provided near the crossed position of said lance 422 and gripper 41. The fillister 422*b*, as shown in FIG. 4, is between the projection 421*c* and the lance 422. The fillister is suitable for catching the lip 22 of the tab 21 of a press-off easy-open can, as shown in FIG. 5. The bottom edge 424 of the lance 422 is also of a suitable arched surface of incline extended from the bottom end of lip rest 422*a* to the gripper 41. The upper edge 423 and bottom edge 424 of said lance 422 meet with each other at the end edge 422*c* of lip rest 422*a* to form an acute angle. The thickness of the end edge 422*c* of the lip rest 422*a* is limited to one-half less than the thickness of the lip rest 22 of the retained cap 21 of the press-off easy-open can cap 11 in general. The distance between the fillister 422*b* of lance 422 and the lip rest 421*a* of jaw 421 is approximately equal to the length of the retained cap 21 on the press-off easy-open can cap 11. A hang ring 431 at the tail 43 of the gripper 41 may be hooked and hung on a key chain in favor of portability.

Since the thickness of the end edge 422*c* of lance 422 is limited to one-half less than the thickness of the lip rest 22 of the retained cap 21 of the press-off easy-open can cap 11, when using this invention, the lip rest 422*a* of the lance 422 contacts with the lip rest 22 of the retained cap 21, applying only a small amount of force downward can easily insert the lance 422 beneath the bottom edge of retained cap 21 and let the lip rest 22 of the retained cap 21 catch in the fillister 422*b* in the rear of the upper edge 423 of said lance 422. Thus one end of the lip rest 22 of the retained cap 21 is pulled up by means of the thrust of inserting the lance 422 beneath the bottom edge of the retained cap 21 so that the end 23 of the retained cap 21 generates a downward pressure in keeping with the force of pressure applied by the jaw 421 of the combination can opener to rapidly press and split off the tongue-shaped can seal 12 on the can cap 11.

Figure 6:
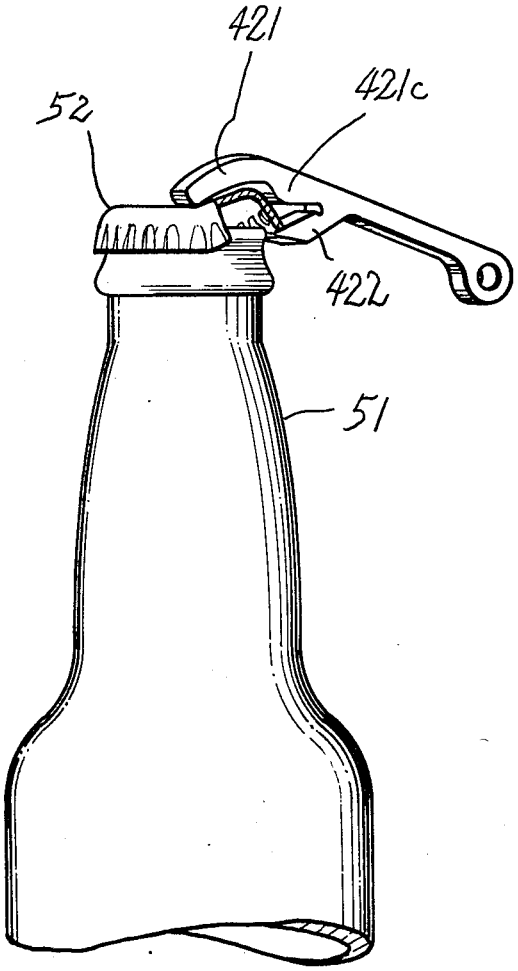
FIG. 6 is an elevation view, partly broken away, of a can and a cap opener according to the present invention being used to remove a cap from a bottle.

The advantage of this invention consists in the small size of the combination can opener (about only 5 cm long). One embodiment of this invention is made of light and hard aluminum alloy and may be hooked and hung on a key chain through the hang ring 431 at end tail 43, and it is portable wherever and whenever. Through the designed acute angle at lip rest 422*a* of the lance 422, the lance 422 can be easily inserted beneath the bottom edge of the retained cap 21 of press-off easy-open can cap 11. Through the fillister 422*b* on the upper edge 423 of the lance 422, when said lance 422 is inserted beneath the bottom edge of the retained cap 21, the lip rest 22 of the retained cap 21 is naturally caught in the fillister 422*b* of the lance 422 at once so that the lance 422 can easily pull up one end of the lip rest 22 of the retained cap 21. It is not necessary to apply much pressure to prevent the said one end of lip rest 22 of retained cap 21 from sliding off and then causing jaw 421 to move rearwand to press and fracture the retained cap 21, and the bottle cap 52 of a bottle 51, as shown in FIG. 6, in general can also be easily wrenched open by a combination can opener according to the present invention by making use of the opening structure of jaw 421 and the lance 422.

I claim:

1. A combination cap and can opener suitable for opening a capped bottle and for opening a press-off easy-open can having a can cap (11) with a can seal (12) which can be split off from the can cap (11), the can also having a tab (21) connected to the can cap (11), the tab (21) having a lip (22) and a front end (23), the lip (22) being capable of being forced upward so that the front end (23) of the tab (21) pushes down on the can seal (12) to split off the can seal (12) and force the can seal (12) inside of the can, the opener also being suitable for wrenching off a bottle cap (52) from a bottle (51), the opener comprising a gripper (41) having a front section (44) and a tail end (43), the front section comprising:

(a) a forwardly projecting lance (422) having an upper edge (423) and a bottom edge (424), the two edges meeting to form an acute angle at an end edge (422*c*);

(b) an arched jaw (421) extending above and forwardly of the lance (422), the jaw (421) having a base portion (421*a*) and a front tip portion (421*b*), the front tip portion (421*b*) arching forwardly and downwardly toward the lance (422);

(c) a projection (421*c*) on the base portion (421*a*) of the jaw (421);

(d) a fillister (422*b*) between the projection (421*c*) and the lance (422), the fillister (422*b*) being sized and shaped for catching the lip (22) of the tab (21) of a press-off easy-open can, wherein the thickness of the end edge (422*c*) of the lance (422) is less than about half of the thickness of the lip (22) of the tab (21) so that the lance (422) can be inserted beneath the tab (21) for pushing the lip (22) of the tab (21) upwardly, and wherein the distance between the fillister (422*b*) and the front tip portion (421*b*) of the jaw (421) is slightly less than the length of the tab (21) and the length of the jaw (421) is sufficiently short such that when the lip (22) of the tab (21) is caught in the fillister (422*b*) and the tail end (43) of the gripper (41) is lifted, the front tip portion (421*b*) presses down to force the can seal to split off rapidly from the can without the jaw (421) reaching inside of the can; and (e) means for wrenching off a bottle cap (52) from a capped bottle (51), the wrenching means being formed by the jaw (421) and the lance (422), the front tip portion (421*b*) of the jaw (421) projecting forwardly of the lance (422) a sufficient amount and curving downwardly toward the lance (422) a sufficient amount that when the lance (422) is under a bottle cap (52) on a bottle (51), the front tip portion (421*b*) of the jaw (421) is on top of the bottle cap (52), the projection (421*c*) not interfering with the lance (422) being placed under the bottle cap (52).

2. The opener of claim 1 being only about 5 cm long.

3. The opener of claim 1 formed of aluminum alloy.

4. The opener of claim 2 formed of aluminum alloy.

5. The opener of claim 1 having a hang ring (431) at the tail end (43) of the gripper (41) for hanging the opener on a key chain.

* * * * *